United States Patent [19]

Gueret

[11] 4,407,311

[45] Oct. 4, 1983

[54] MAKE-UP UNIT WITH AN ADJUSTABLE WIPER DEVICE

[75] Inventor: Jean-Louis H. Gueret, Paris, France

[73] Assignee: L'Oreal, Paris, France

[21] Appl. No.: 435,313

[22] Filed: Oct. 19, 1982

[30] Foreign Application Priority Data

Nov. 6, 1981 [FR] France ..... 81 20808

[51] Int. Cl.[3] ..... A45D 40/30

[52] U.S. Cl. ..... 132/88.5; 401/130

[58] Field of Search ..... 132/88.5, 88.7; 15/167 R, 160; 401/130

[56] References Cited

U.S. PATENT DOCUMENTS 3,662,769 5/1972 Vasas ..... 132/88.7
4,135,527 1/1979 Montiel ..... 132/88.7
4,261,376 4/1981 Kingsford ..... 132/88.5
4,341,231 7/1982 Costa ..... 132/88.5

*Primary Examiner*—Gregory E. McNeill
*Attorney, Agent, or Firm*—Cushman, Darby & Cushman

[57] ABSTRACT

A make-up element comprises a bottle of make-up product receiving an applicator which is to be variably wiped to remove excess make-up product therefrom as it is withdrawn from the bottle. The wiping action is exerted by a wiper sleeve adjustable in cross-section by rotation of a manipulating sleeve, which may or may not be threaded to move axially of the bottle neck upon rotation. A peripheral sliding element between the wiper sleeve and the manipulating sleeve serves to avoid damage to the wiper sleeve as a result of repeated rotation of the sleeve with respect to a cross-section-adjusting formation externally thereof.

13 Claims, 7 Drawing Figures

MAKE-UP UNIT WITH AN ADJUSTABLE WIPER DEVICE

FIELD OF THE INVENTION

The present invention concerns a make-up unit comprising a make-up product bottle and an applicator penetrating inside the bottle via the adjustable opening of an annular deformable wiper device exerting a wiping action on the make up end fitting carried by the applicator, such as a brush, with a view to eliminating the excess of the make-up product taken up by the brush inside the bottle.

PRIOR ART

A make-up unit as defined above has already been disclosed in published European Patent Application No. 0,002,301. In this publication, the wiper device may take the shape of a soft, elastically deformable sleeve disposed within a cup having an open bottom which is itself fitted within the neck of the make-up bottle. The wiper sleeve forms the passage through which the applicator penetrates inside the bottle or is withdrawn therefrom. An operating device allows the wiper sleeve to be axially compressed with a view to varying the diameter of its opening and hence the extent of the wiping. Such a device may consist of a threaded socket screwed within the cup within the open end in which the wiper sleeve is accommodated.

A device of the type indicated above has the following major drawback: the operating device is a screwing element whose movement derives from the combination of a translation and a rotation. Thus when the operating device is screwed into the bottle to a greater or lesser degree to compress the wiper sleeve axially and cause the dimension of its opening to be varied, the rotational movement of the operating device is transmitted to the wiper sleeve which, moreover, bears on a fixed element integral with the bottle neck. This inevitably causes a torsional deformation of the wiper sleeve which, after a limited number of operations, rapidly deteriorates and becomes useless.

SUMMARY OF THE INVENTION

It is an object of the present invention to overcome the above mentioned drawback.

It is a further object to provide a make-up unit wherein the annular deformable wiper means with an adjustable opening is not subjected to torsion causing it to deteriorate.

Another object of the invention is to propose an altogether original make-up unit in relation to the embodiment described in the above mentioned published European Patent Application wherein the annular wiper means comprises an oblong opening whose cross-section is caused to vary by orienting it angularly in relation to at least one fixed projection exerting a radial compression on the projection, this angular orientation being effected by means of a manipulating device which can only have a relative rotational movement without any scope for translation in relation to the neck of the bottle.

In accordance with the present invention, a peripheral sliding element avoiding the torsional deformation of the annular wiper means is inserted between the operating device and the annular wiper means.

The object of the present invention is therefore a make-up unit comprising: a bottle for a make-up product; applicator means; deformable annular wiper means having an adjustable opening capable of receiving the applicator means, the said annular wiper means being at least partly accommodated within the bottle neck; and movable manipulating means for variably forming the annular wiper means to cause the cross-section of its opening to vary, and a peripheral sliding element inserted between the movable manipulating means and the annular wiper means to avoid torsional deformation of the annular wiper means.

In a first embodiment of the invention, the movable manipulating means is a screwable element cooperating with the wall of the bottle neck or of an element which is integral therewith. In this case, the peripheral sliding element consists of at least one washer inserted within the neck of the bottle between the annular wiper means and the part of the screwable element deforming said annular wiper means.

The sliding washer may be made of any material having low friction properties, for instance polyethylene, so that the rotation of the screwable element which constitutes the movable manipulating means should not be transmitted to the annular wiper device. The annular wiper means is held within the bottle neck by means of a stop which is integral with the bottle and arranged on the side of the annular wiper means which is on the opposite side from the sliding washer.

Preferably, the stop is made integrally with the wall of the bottle and comprises and annular shoulder arranged within the neck in the zone where it is joined to the barrel of the bottle.

According to another characteristic of this first embodiment, the annular wiper means comprises an elastically deformable sleeve having a wall thickness which may or may not be variable. The wiper sleeve may, for instance, be made of natural or synthetic rubber.

The screwing manipulating means advantageously consists of a collar comprising two substantially coaxial skirts; on the one hand, an external skirt whose inner thread cooperates with the outer thread of the bottle neck and, on the other hand, an internal skirt penetrating within the neck of the bottle and coming to bear against the sliding washer.

In a second embodiment of the invention, the movable manipulating means is an element which is rotatably mounted on the neck of the bottle or on an element which is integral therewith. In this case, the annular wiper means comprises an oblong opening and the rotational manipulating means allows the angular orientation of the annular wiper means in relation to at least one internal projection of the neck of the bottle exerting a deformation on it. Within the peripheral sliding element accommodated in the bottle neck, there is disposed the annular wiper means with the oblong opening.

According to another characteristic of this second embodiment, the annular wiper means and the peripheral sliding element are integral with the rotational manipulating means whilst the internal projection of the neck of the bottle is made integrally with the wall of the said bottle. Provision is advantageously made for two said inner diametrically opposite projections compressing the annular wiping means within its peripheral sliding element.

According to another preferred characteristic, the annular wiper means is a sleeve resembling a glove finger made of a soft, elastically deformable material, having the oblong opening in the bottom thereof. The peripheral sliding element advantageously comprises an internal skirt consisting of a multiplicity of strips which are free at their ends which face the bottom of the bottle and are interconnected at their other ends; the strips of the internal skirt are regularly interspaced and each disposed along a generatrix of a cylinder with a circular base. The external diameter of the internal skirt with the strips constituting the peripheral sliding element is smaller than the distance separating the two internal diametrically opposite projections of the bottle neck, whilst its internal diameter is substantially equal to the external diameter of the glove finger made of a soft, elastically deformable material constituting the annular wiper device.

In the two embodiments of the invention, the make-up applicator may consist of a conventional make-up end fitting, such as a spatula or a brush, carried by a rod. The bottle of the make-up unit may contain make-up products intended to be drawn off and deposited by means of an applicator; such products may, for instance, be an eyelash reinforcing product or mascara.

BRIEF SUMMARY OF THE DRAWINGS

To render the object of the present invention more readily understood, there will be described below two embodiments shown in the attached drawings by way of purely illustrative and non-restrictive examples.

In these drawings.

DETAILED DESCRIPTION OF THE PREFERRED EMBODIMENTS

Figure 1:
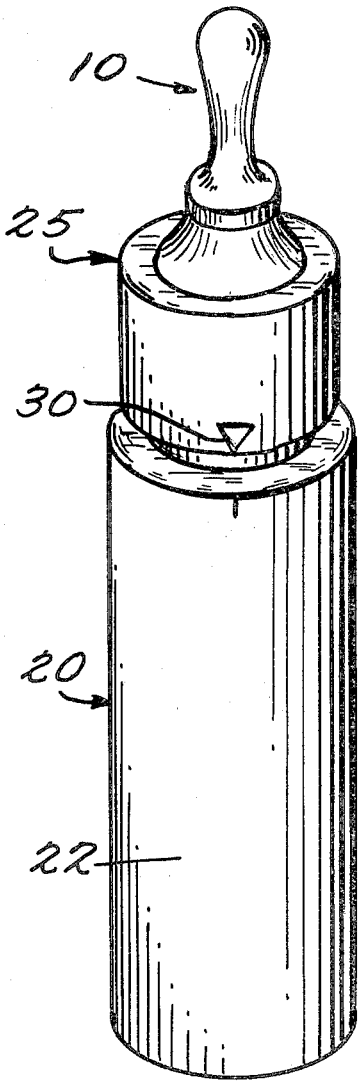
FIG. 1 is a view in perspective of a make-up unit according to the first embodiment of the invention.
Figure 2:
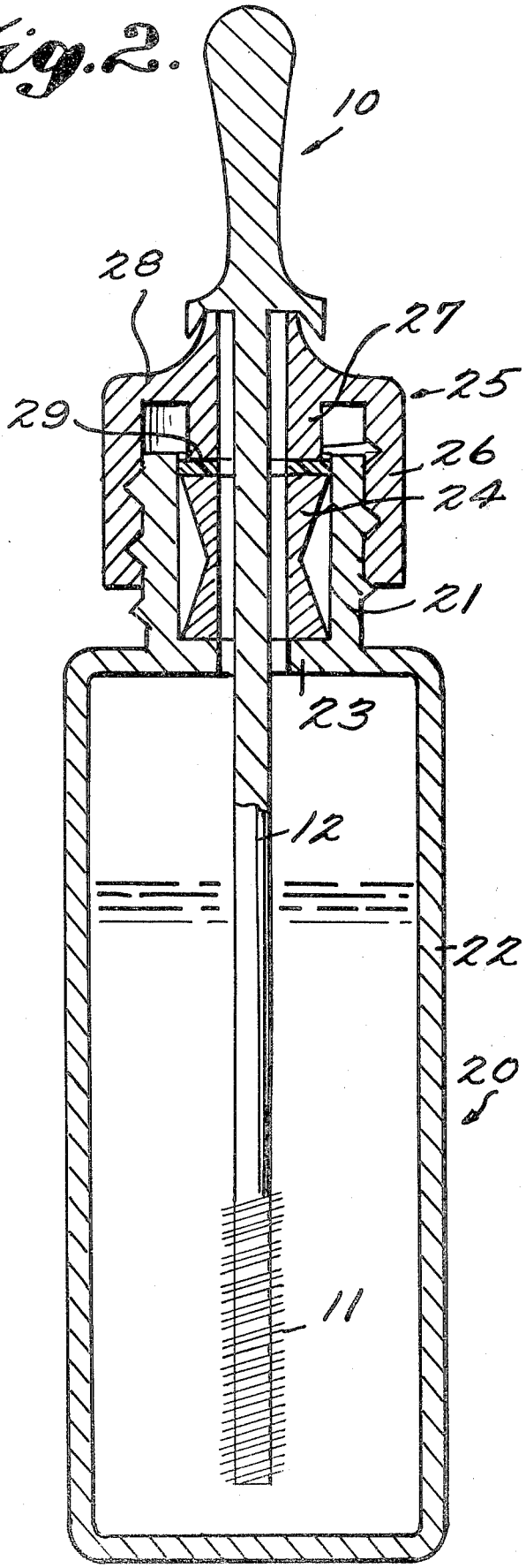
FIGS. 2, 3 and 4 are axial cross sections of the unit of FIG. 1, the make-up bottle being shown respectively in a completely open, half opened and closed position.

Referring to FIGS. 1 to 4 of the drawings, it will be seen that a unit has been shown which may be used for the purpose of making-up the eyes.

This make-up unit consists of an applicator 10 and a bottle 20 filled with a coloured liquid called "eye-liner". Within bottle 20, in the connecting zone of the neck 21 with the barrel 22 of the bottle, there is arranged an annular shoulder 23. Neck 21 has an external thread.

The make-up bottle 20 is made of glass or a moulded plastic material. It is only distinguished from the usual bottle or container by the presence of the annular shoulder 23.

The make-up applicator 10 consists of a brush 11 and a brush carrier rod 12.

The excess of the product taken up by the brush may be brushed as the applicator 10 is extracted from the make-up bottle 20 *by means of* a deformable wiper sleeve 24 with an adjustable opening. The wiper sleeve 24 is kept within the threaded neck 21 of the bottle by means of the annular shoulder 23 whereon it bears. It may be made of any soft, elastically deformable material, for instance of natural or synthetic rubber. The internal diameter of the wiper sleeve 24 is substantially constant, and equal to that defined by the annular shoulder 23. The outer wall of the wiper sleeve 24 is provided with an annular recess which has, viewed in an axial cross section, the shape of a flattened V. The external diameter of the wiper sleeve 24 is therefore variable: it passes through a maximum near its two ends and has a minimum in its axially central portion, whilst progressively varying between these two extreme values. As a variant, the wiper sleeve 24 may have a wall with a substantially constant thickness.

Figure 3:
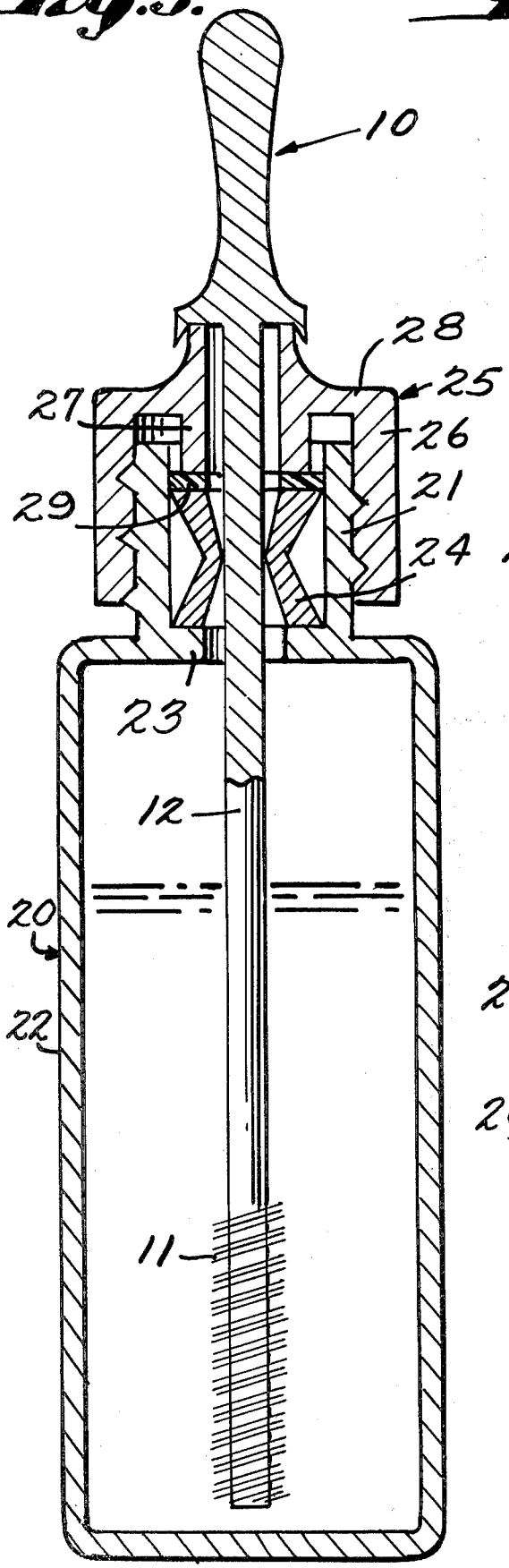
Figure 4:
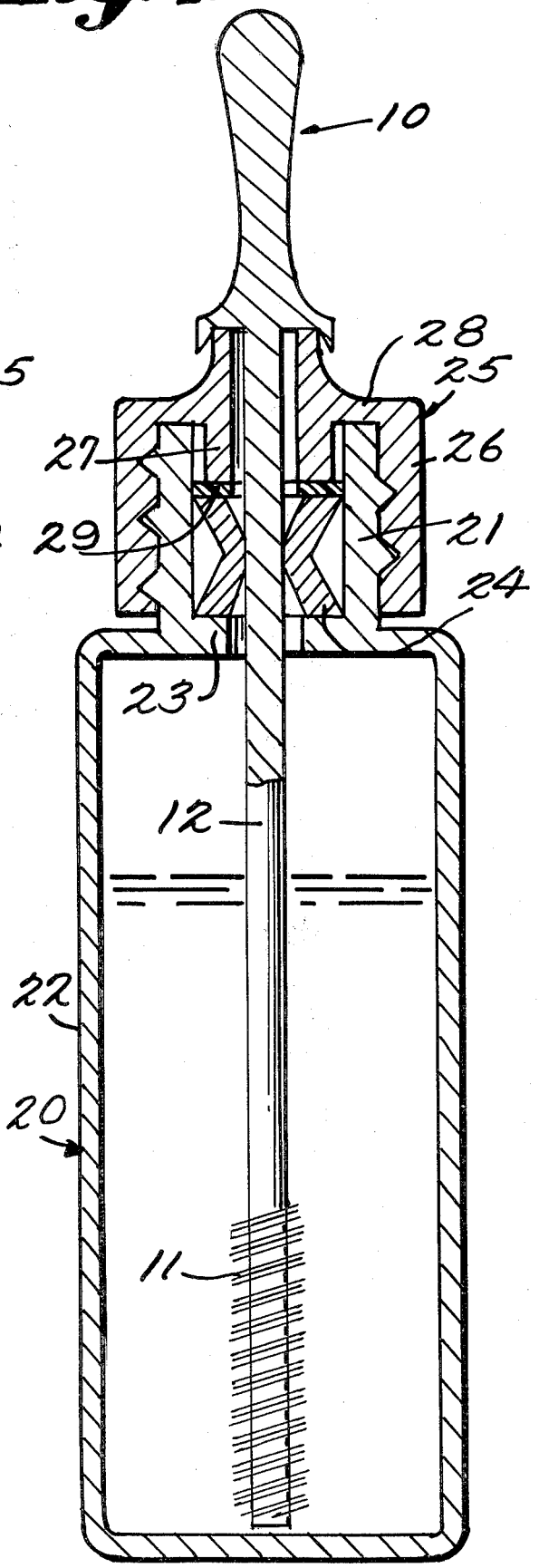

If an axial pressure is exerted on the wiper sleeve 24 bearing on the annular shoulder 23, there is produced an elastic deformation of the sleeve and a radial contraction of its central portion which is reflected in a reduction of the internal diameter of its opening (FIGS. 3 and 4).

The operating device allowing the wiper sleeve 24 to be axially compressed to cause the diameter of its opening to vary, consists of an internally threaded collar 25 made of a moulded plastic material. The operating collar 25 is composed of two coaxial skirts 26, 27 joined to each other by an annular end piece 28; the external skirt 26 has a female thread whose pitch corresponds to that of the male thread on neck 21. The internal skirt 27 penetrates inside neck 21; its internal diameter is substantially equal to that of the wiper sleeve 24 in a non-compressed state.

Between the wiper sleeve 24 and the internal skirt 27 of the operating collar, there is inserted a sliding washer 29 in the shape of a thin disc. The sliding washer 29 may be made of polyethylene or of any other material having low friction properties. Its internal diameter is substantially equal to that of the wiper sleeve 24, whilst its external diameter is substantially equal to the internal diameter of the threaded neck 21. The purpose of the sliding washer 29 is to prevent the rotational component of the twisting movement imparted to the internal skirt 27 by screwing the operating collar 25 up or down from being transmitted to the wiper sleeve 24 which would be reflected in a torsional deformation of the said sleeve and would cause it to deteriorate. Thanks to the sliding washer 29 and to the ensuing reduction in the coefficient of friction, the rotation of collar 27 is not communicated to the wiper sleeve 24 which is simply subjected to an axial compression.

In screwing the operating collar 25 on to the neck 21 of the bottle, the user causes a corresponding lowering of the internal skirt 27 of the collar inside the neck 21 and an axial squashing of the wiper sleeve 24 depending on the extent of the screwing action. The diameter of the brush carrier rod 12 is smaller than the internal diameter of the wiper sleeve 24 in its uncompressed state.

In the position of FIG. 1 the operating collar 25 is sufficiently screwed on to neck 21 to be solidly maintained on the latter but without compressing the wiper sleeve 24. The user may easily withdraw the applicator 10 from the bottle 20; as the brush 11, which was immersed in the make-up liquid, passes through the compressed sleeve 24 this produces a light wiping of the brush.

If the user wishes to obtain a more pronounced wiping of brush 11, she screws down the operating collar 25 further until approximately half of its travel. In this position (FIG. 3), the wiper sleeve 24 is compressed by the internal skirt 27 of the operating collar 25 and comes to squeeze the brush carrier rod slightly; the user may, nevertheless, still withdraw applicator 10 from bottle 22 and the make-up brush 11, on passing through the wiper sleeve 24, is squeezed within the said sleeve which makes it possible to remove therefrom a portion of the coloured liquid that it contained. There ensues a more pronounced wiping than that effected in the position of FIG. 2. After making-up, the user may, before reintroducing the applicator 10 inside the bottle 20, unscrew the operating collar 25 in order to bring it into the open position of FIG. 2 and thus to facilitate the introduction of the brush 11.

To close the bottle 20 in a leakproof manner, after having placed applicator 10 in position therein, the operator must screw down the operating collar 25. In the closed position of FIG. 3, the wiper sleeve 24 is sufficiently compressed around the brush carrier rod 12 to effect the seal. The three rotational orientations of the collar 25 to obtain the positions illustrated in FIGS. 2, 3 and 4 may be marked by means of an arrow head 30 (FIG. 1) engraved on the external skirt of the operating collar 25 and three graduations on barrel 22 of the bottle.

The make-up unit described above has a two-fold advantage: firstly, not only does it enable the extent of the wiping to be regulated but it does, moreover, ensure a uniform wiping of the make-up end fitting whatever its form, whether it takes the shape of a brush or a spatula. In effect, thanks to its flexible nature, the wiper sleeve 24 closely fits the side of the make-up end fitting, thus ensuring a regular wiping action over all of its surface. Secondly, it is the make-up applicator 10 itself which forms the stoppering device of the bottle: it is therefore possible to provide an applicator consisting of a rod whose "handle" end is not provided with a bulky, generally unsightly stopper intended to be screwed on to the neck of the associated bottle.

Figure 5:
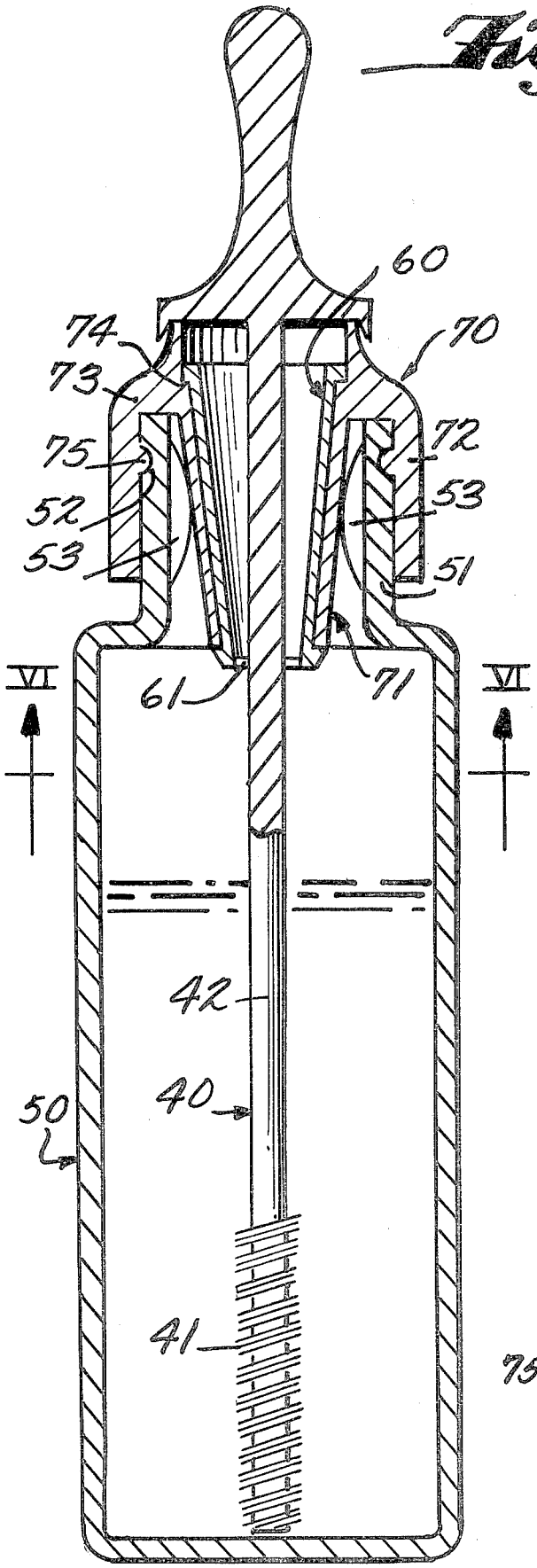
FIG. 5 is an axial cross section of a make-up unit according to the second embodiment of the invention.
Figure 6:
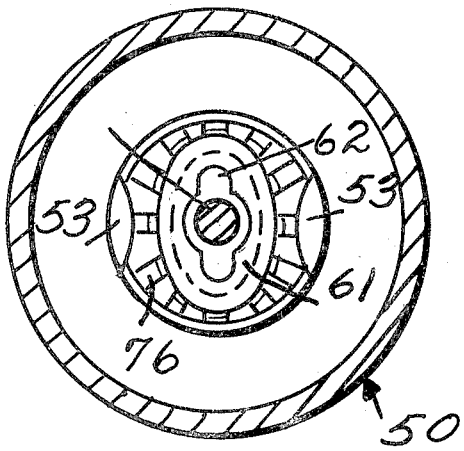
FIG. 6 is a cross section along VI–VI of the unit of FIG. 5.
Figure 7:
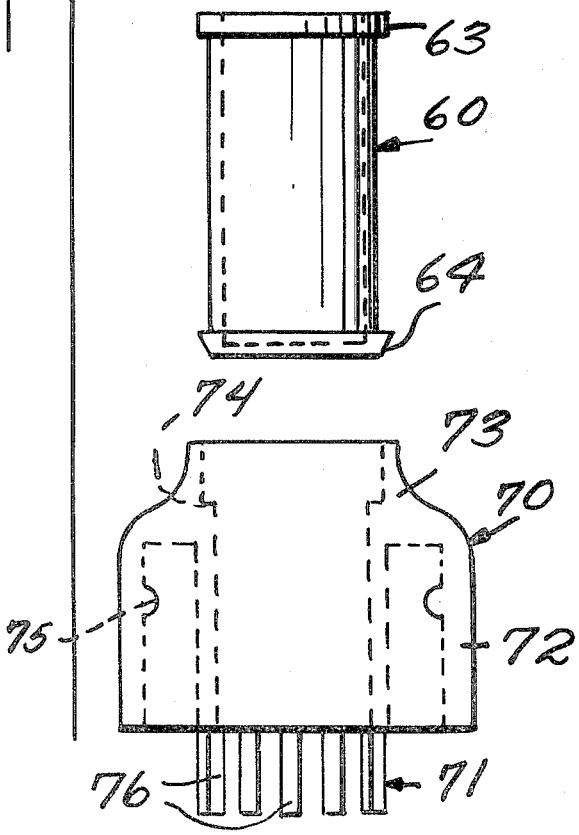
FIG. 7 is an exploded elevational view of the annular wiper device on the one hand and of the rotational operating collar on the other hand and of the adjoining peripheral sliding device equipping the make-up units of FIGS. 5 and 6.

FIGS. 5 to 7 show a make-up unit according to the second embodiment of the invention. It consists of a make-up applicator 40 and a bottle 50 containing the make-up product.

The make-up applicator 40 is, in all respects, identical with the applicator 10 of FIGS. 1 to 4; it is formed by a brush 41 and a brush carrier rod 42.

The bottle 50 is made of glass or a plastic material. The neck 51 of the bottle is provided on its outside, near its rim, with a peripheral groove 52; internally it comprises two diametrically opposite fins 53 which project from the inner cylindrical wall of neck 51 and extend along one of the generatrices of the said cylindrical wall.

The annular wiper sleeve of the make-up unit of FIG. 5, designated 60 as a whole, has the shape of a glove finger made of a soft, elastically deformable material, such as natural or synthetic rubber. The bottom wall 61 of the wiper sleeve 60 has an oblong opening 62 whose flexible edge exerts a wiping action on the brush 41. In its uncompressed state (FIG. 7), the wiper sleeve 60 has the shape of a circular cylinder with its bottom wall 61 flat. At each of its ends, it is provided with a peripheral flange 63, 64 projecting radially outwardly.

The rotational manipulating device allowing the angular orientation of the annular wiper sleeve 60, and hence of its oblong opening 62, in relation to the two fins 53 is formed by a collar 70 of a plastic material. The rotational manipulating collar 70 consists of two coaxial skirts 71, 72 connected by an annular end piece 73. The substantially rigid external skirt 72 comprises an internal retaining ring 75 able to be catch-engaged within the peripheral groove 52 of the neck 51. The catch-engagement of retaining ring 75 of the manipulating collar 70 within the peripheral groove 52 ensures the translational liaison between the collar 70 and the neck 51 of the bottle, whilst allowing the collar 70 to rotate in relation to the bottle.

The internal skirt 71 of the rotational manipulating collar 70, when it is not arranged within the neck 51 of the bottle where it is compressed by the two internal fins 53, has the shape of a circular cylinder. It is formed by a multiplicity of regularly interspaced strips 76, each disposed along one of the generatrices of a cylinder, having a free end directed towards the inside of bottle 50, but being joined at its other end to the end piece 73 of the rotational manipulating collar 70.

The internal diameter of the thus-defined internal skirt 71 is greater than the distance separating the two inner ribs 53 of the neck 51 so that it has, in the axial cross-section of FIG. 5, the frusto conical shape and in a radial cross-section (FIG. 6), an oblong shape.

The annular wiper sleeve 60 is accommodated within the strips 76 of the internal skirt 71; its external contour substantially conforms to that of the internal skirt 71. It is held axially within the internal skirt 71 by means of, on the one hand, the flange 63 which comes to be accommodated within a peripheral cut-out 74 and, on the other hand, the flange 64 which bears upwardly on the free end edge of strips 76.

The rotational operating collar 70 allows the angular orientation of the annular wiper sleeve 60, and hence of its oblong opening 62, in relation to two internal fins 53 which exert on it a radial compression, thus causing the cross-section of the opening, and hence the extent of the wiping exerted on brush 41, to vary. The wiper device 60 may take up three characteristic angular positions in relation to the two internal fins 53:

In a first position, the major axis of the oblong opening 62 is disposed (as illustrated in FIG. 6) perpendicular to the diameter joining the tips of the two internal fins 53. The oblong opening 62 in the bottom wall 61 has the smallest dimension and the wiping action is therefore at its maximum.

In a second position, where the bottom wall 61 has its oblong opening 62 arranged to have its greatest size and where the wiping action exerted on brush 41 is therefore at its minimum, the major axis of the oblong opening 62 is substantially identical with the diameter joining the two fins 53.

In a third position, where the oblong opening 62 is in a central position in relation to the two preceding ones, the major axis of the oblong opening 62 makes an angle of 45° in relation to the diameter joining the two internal fins 53.

Thus it will seen that, depending on its angular orientation in relation to the two internal fins 53 which compress it radially, the wiper sleeve 60 may exert a pronounced wiping action, a medium action or a weak wiping action on brush 41 of the applicator 40. As before, these three positions may be marked on the outside of the bottle, for instance by an arrow head on the external skirt 72 of the rotational manipulating collar 70 and three marks on the barrel of the bottle.

The internal skirt 71 formed of the strips 76 serves, in the embodiment of FIGS. 5 to 7, as the peripheral sliding element within which there is accommodated the annular wiper sleeve 60 intended to prevent any torsional deformation of the annular wiper sleeve 60. In fact, the internal skirt 71 rotates together with the annular wiper sleeve 60, and the strips 76 of the said skirt form many rigid levers articulated at their top ends to the wall of the collar 60, which rigid levers can be close to the axis of the bottle neck at the time when they touch the two internal fins 53. The annular wiper sleeve 60 within strips 76 of the internal skirt 71 is therefore not subjected to any shear stress liable to damage it.

It shall be duly understood that the two embodiments described above are in no way restrictive and may give rise to any desirable modifications without thereby departing from the scope of the invention.

I claim:

1. In a make-up unit comprising:

(a) a bottle for containing a make-up product, and having a barrel and a neck;

(b) an applicator;

(c) annular wiper means defining an adjustable opening capable of receiving said applicator, said annular wiper means being at least partly accommodated within the neck of the bottle; and (d) movable manipulating means for variably deforming said annular wiper means to vary the cross-section of its said opening; the improvement comprising:

(e) a peripheral sliding element disposed between said movable manipulating means and the annular wiper means (24, 60) to avoid torsional deformation of the annular wiper means upon movement of said movable manipulating means.

2. A make-up unit according to claim 1, wherein the movable manipulating means comprises screwable means cooperating with said bottle.

3. A make-up unit according to claim 2, wherein said peripheral sliding element consists of at least one washer inserted within the neck of the bottle between said annular wiper means and said movable manipulating means.

4. A make-up unit according to claim 3, wherein said annular wiper means has a first end adjacent said washer and a second end remote therefrom; and further including stop means, integral with the bottle and disposed adjacent said second end of the annular wiper means, for holding the annular wiper means within the neck of the bottle.

5. A make-up unit according to claim 4, wherein said stop means comprises an annular shoulder arranged within the neck of the bottle in the connecting zone between the neck and the barrel of the bottle.

6. A make-up unit according to claim 1, wherein said annular wiper means comprises an elastically deformable sleeve.

7. A make-up unit according to claim 4, wherein the bottle neck has an external screw thread; and wherein said screwable manipulating means consists of a collar comprising first and second substantially coaxial skirts of which said second skirt is disposed radially within said first skirt, and means defining an internal thread on said first skirt to cooperate with the external thread of the bottle, said second skirt being arranged to enter the neck of the bottle and to bear against said washer.

8. A make-up unit according to claim 1, wherein said bottle neck includes internal projection means, wherein said annular wiper means comprises an oblong opening, and wherein the movable manipulating means is an element rotatably mounted on said bottle, said movable manipulating means being effective to vary the angular orientation of the annular wiper means in relation to said internal projection means of the neck of the bottle, thereby effecting deformation of said annular wiper means.

9. A make-up unit according to claim 8, wherein the annular wiper means and said peripheral sliding element are integral with said rotational manipulating means, and said internal projection means of the neck of the bottle are made integrally with said bottle.

10. A make-up unit according to claim 9, wherein said internal projection means of the bottle comprise two diametrically opposite internal projections for compressing the annular wiper means within its peripheral sliding element.

11. A make-up unit according to claim 8, wherein the annular wiper means comprises a sleeve of a soft, elastically deformable material and has said oblong opening in the bottom thereof.

12. A make-up unit according to claim 8, wherein said peripheral sliding element includes skirt means comprising a multiplicity of strips each having a first free end nearer the bottom of the bottle, and including means interconnecting said strips at their second ends.

13. A make-up unit according to claim 10, wherein said annular wiper means comprises a sleeve made of a soft, elastically deformable material; and wherein the skirt means has an external diameter which is smaller than the distance separating said two diametrically opposite internal projections of the neck of the bottle, and has an internal diameter which is substantially equal to the external diameter of said sleeve.

* * * * *